US005301646A

United States Patent [19]

Doi et al.

[11] Patent Number: 5,301,646

[45] Date of Patent: Apr. 12, 1994

[54] THROTTLE CONTROL APPARATUS

[75] Inventors: Shoichi Doi, Kariya; Masaru Shimizu, Toyota; Mitsuo Kikkawa, Anjo; Shinichiro Tanaka, Mishima; Keiji Aoki, Susono, all of Japan

[73] Assignees: Aisin Seiki Kabushiki Kaisha, Kariya; Toyota Jidosha Kabushiki Kaisha, Toyota, both of Japan

[21] Appl. No.: 994,319

[22] Filed: Dec. 21, 1992

[30] Foreign Application Priority Data

Dec. 27, 1991 [JP] Japan ..... 3-359593
Dec. 27, 1991 [JP] Japan ..... 3-359614

[51] Int. Cl.[5] ..... F02D 11/10
[52] U.S. Cl. ..... 123/399
[58] Field of Search ..... 123/361, 396, 399, 400, 123/403

[56] References Cited

U.S. PATENT DOCUMENTS

| | | | |
|---|---|---|---|
| 4,995,363 | 2/1991 | Terazawa et al. | 123/399 |
| 5,016,589 | 5/1991 | Terazawa | 123/399 |
| 5,027,766 | 7/1991 | Zentgraf et al. | 123/361 |
| 5,092,296 | 3/1992 | Gunther et al. | 123/399 X |
| 5,161,507 | 11/1992 | Terazawa et al. | 123/399 |
| 5,201,291 | 4/1993 | Katoh et al. | 123/399 |

FOREIGN PATENT DOCUMENTS 4-224242 8/1992 Japan .

*Primary Examiner*—Willis R. Wolfe
*Attorney, Agent, or Firm*—Burns, Doane, Swecker & Mathis

[57] ABSTRACT

The invention is directed to a throttle control apparatus for use in an internal combustion engine. The apparatus includes an accelerator operating mechanism, a driving source, and a supporting member secured to an end portion of a throttle shaft extending out of a housing. A rotor is rotatably mounted on the throttle shaft, and connected with the driving source to be rotated thereby. A movable member is mounted on the throttle shaft between the rotor and the supporting member to be axially movable. A connecting member is disposed for connecting the movable member with the supporting member, and biasing the former toward the latter. An electromagnetic coil is disposed to face the rotor. There is provided an engaging member which has a base end mounted on the movable member for supporting the engaging member rotatably within a predetermined angle range. A driving member having an end face engageable with the engaging member is mounted rotatably about an axis parallel with the axis of the throttle shaft, and connected with the accelerator operating mechanism. The engaging member has an axial length engageable with the end face of the driving member only when the movable member is positioned at the side of the supporting member.

16 Claims, 8 Drawing Sheets

THROTTLE CONTROL APPARATUS

BACKGROUND OF THE INVENTION

1. Field of the Invention

The present invention relates to a throttle control apparatus mounted on an internal combustion engine, and more particularly to a throttle control apparatus which controls an opening angle of a throttle valve by a driving source such as a motor activated in response to operation of an accelerator operating mechanism, and which enables the accelerator operating mechanism to directly control the opening angle of the throttle valve, when the driving source is inoperative.

2. Description of the Related Art

Conventionally, an accelerator operating mechanism has been mechanically connected to a throttle valve, whereas an apparatus for opening and closing the throttle valve, or controlling an opening angle of the throttle valve by a driving source such as a motor in response to operation of an accelerator pedal has been proposed recently. For example, Japanese Patent Laid-open Publication No. 2-204641 disclose a device including means for opening and closing a throttle valve, second driving means driven by a driving source in response to operation of an accelerator operating mechanism, and clutch means for connecting or disconnecting them.

The device is so arranged that when the driving source operates abnormally, the clutch means, which connects the throttle opening means and the second driving means driven by the driving source, will be disconnected, and then the throttle opening means will be driven by first driving means, if the accelerator operating mechanism is operated more than a predetermined amount, to obtain a desired opening angle of the throttle valve. More particularly, in the case where an electromagnetic clutch mechanism constituting the clutch means is de energized, when the accelerator pedal is depressed more than the predetermined amount, it will be mechanically connected with the throttle opening means to obtain the desired opening angle of the throttle valve.

The device disclosed in the above-described publication may perform a so-called traction control. However, if a driver of an automobile depresses the accelerator pedal more than the predetermined amount in the traction control mode, the throttle valve will be opened irrespective of the traction control mode. In this case, if the throttle valve has been required to be fully closed in the traction control mode, the desired acceleration slip control will not be made.

In order to avoid this problem, the device may be structured as follows. First of all, a supporting member is fixed to an extending portion of a throttle shaft to be held at a certain position thereof and restricted from moving in the axial direction thereof. On the extending portion, a rotor is mounted rotatably, and a movable member is mounted between the rotor and the supporting member movably in the axial direction of the throttle shaft. The movable member and the supporting member are connected by a connecting member, e.g., a leaf spring, to bias the movable member toward the supporting member. At a position facing the rotor, disposed is an electromagnetic coil, which is arranged to attract the movable member toward the rotor when energized. The movable member is provided with a pin which extends in parallel with the axis of the throttle shaft. Further, there is provided a driving member which is mounted rotatably about an axis parallel with that of the throttle shaft, and which has an end face to be engageable with the pin perpendicularly to the axis of the throttle shaft. In this case, provided that the axial length of the pin is set to such a length that the pin can be engaged with the end face of the driving member only when the movable member is positioned at the side of the supporting member, as long as the rotor is rotated by the driving force of the driving source, the movable member will not be prevented from rotating, even if the driving member is rotated in response to operation of the accelerator operating mechanism, because the driving member is positioned not to be engaged with the pin.

However, in the case where the electromagnetic coil is de-energized when the driving member is positioned on a line extending axially from the tip end of the pin in the throttle control mode, the movable member might be prevented from being moved toward the supporting member for returning to its initial position, with the pin engaged with the driving member. For example, in the case where the accelerator pedal is depressed largely in the throttle control mode to cause slip of driving wheels so that the acceleration slip control is initiated, if the electromagnetic coil is de-energized by some reason, the pin will contact the driving member to prevent the movable member from returning to its initial position. Depending upon the dimensional relationship among them, therefore, the movable member and rotor might not be disengaged, unless the accelerator pedal is returned to its initial position. Consequently, the driving source and the throttle shaft will be maintained to be engaged with each other, so that the desired acceleration slip control might not be made.

Further, in the case where a single pin is fixed to a position remote from the axial center of the movable member, and the movable member is arranged to be engageable with the rotor at a position remote from the axial center, when the driving member engages with the pin to transmit a driving force thereto in accordance with the accelerator operation, the movable member will be forced to be inclined to its rotational axis, so that the movable member might engage with the rotor. If the movable member is inclined to engage with the rotor, they might be maintained to be engaged with each other, even after the electromagnetic coil is de-energized due to abnormality or the like. In this case, the throttle valve will not be controlled, even if the accelerator operation is made. Whereas, this will not be caused, provided that the clearance between the movable member and the rotor is set to be large enough. In this case, however, a large electromagnetic force will be required, so that not only the large clearance but also a large space for the electromagnetic coil will be needed. Therefore, the apparatus as a whole will become much larger in size than the proposed device in that publication. Although the above described case may rarely happen, it is desirable to provide a structure which will never cause such case, rather than leaving the case as a matter of design.

SUMMARY OF THE INVENTION

Accordingly, it is an object of the present invention to provide a throttle control apparatus which controls an opening angle of a throttle valve by a driving source, and which certainly disengages a throttle shaft from the driving source when the electromagnetic coil is de-energized.

It is another object of the present invention to provide a throttle control apparatus which controls an opening angle of a throttle valve by a driving source, and which disengages a throttle shaft from the driving source and enables an accelerator operating mechanism to directly control the opening angle of the throttle valve.

In accomplishing the above and other objects, a throttle control apparatus for an internal combustion engine according to the present invention, which includes an accelerator operating mechanism and a driving source for producing a driving force in accordance with an amount of operation of the accelerator operating mechanism, a throttle valve which is disposed in a housing mounted on the internal combustion engine, a throttle shaft which is rotatably mounted on the housing for supporting the throttle valve. The throttle shaft has at least an end portion extending out of the housing. The apparatus further includes a supporting member which is secured to the end portion of the throttle shaft, and a rotor which is rotatably mounted on the end portion of the throttle shaft and positioned at a certain position thereof to prevent an axial movement of the rotor on the throttle shaft. The rotor is connected with the driving source to be rotated by the driving force. A movable member is mounted on the throttle shaft between the rotor and the supporting member movably in the axial direction of the throttle shaft. A connecting member is provided for connecting the movable member with the supporting member to bias the movable member toward the supporting member. An electromagnetic coil is secured to the housing so as to face the rotor. This electromagnetic coil is arranged to attract the movable member toward the rotor and connect the movable member and the rotor, when the electromagnetic coil is energized. There is provided an engaging member which has a base end mounted on the movable member for supporting the engaging member rotatably within a predetermined angle range, and which has a free end extending in parallel with the axis of the throttle shaft. A driving member is mounted rotatably about an axis parallel with the axis of the throttle shaft, and has an end face engageable with the engaging member perpendicularly to the axis of the throttle shaft. The driving member is connected with the accelerator operating mechanism to be rotatable in response to operation of the accelerator operating mechanism. The engaging member has an axial length engageable with the end face of the driving member only when the movable member is positioned at the side of the supporting member.

Preferably, the engaging member has an axial length to satisfy that when the electromagnetic coil is de-energized and the engaging member is engageable with the end face of the driving member, a distance in parallel with the axis of the throttle shaft between a free end of the engaging member and a side surface of the driving member facing the movable member is smaller than a distance in parallel with the axis of the throttle shaft between a side surface of the movable member and a side surface of the rotor facing each other, and that when the electromagnetic coil is energized, a certain clearance is made between the free end of the engaging member and the side surface of the driving member.

The engaging member preferably comprises, a pin which has a shaft portion and a head portion provided at an end thereof, which head portion has a spherical surface at an end thereof at least, and a spring member which is mounted on the movable member for pressing the head portion of the pin onto the movable member, and which holds the shaft portion normally in parallel with the axis of the throttle shaft.

The connecting member preferably comprises a leaf spring which has at least a portion thereof fixed to the movable member, and at least another portion fixed to the supporting member. And, the spring member preferably comprises an auxiliary leaf which extends from the leaf spring, and which has an end portion to be engaged with the head portion of the pin for pressing the head portion onto the movable member.

BRIEF DESCRIPTION OF THE DRAWINGS

The above stated objects and following description will become readily apparent with reference to the accompanying drawings, wherein like reference numerals denote like elements, and in which.

DESCRIPTION OF THE PREFERRED EMBODIMENTS

Figure 2:
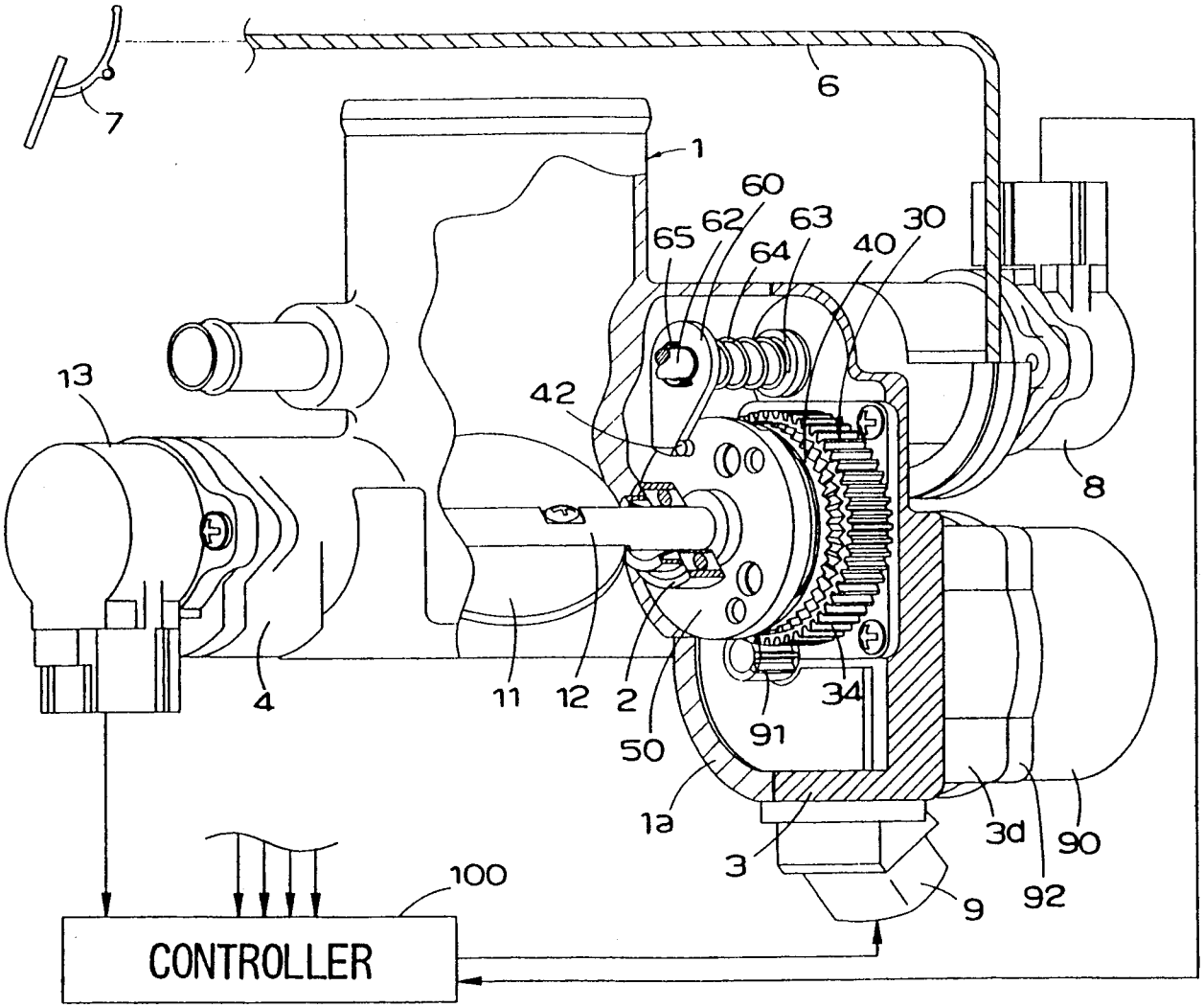
FIG. 2 is a perspective view of a throttle control apparatus according to an embodiment of the present invention.
Figure 3:
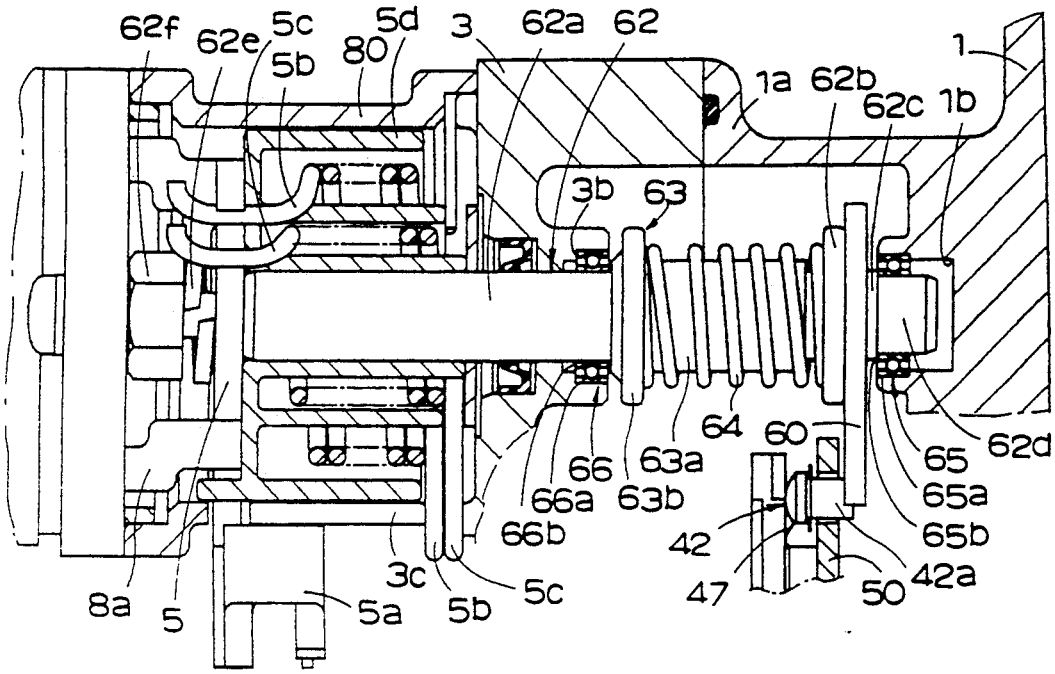
FIG. 3 is an enlarged sectional view of an accelerator shaft section according to an embodiment of the present invention.
Figure 4:
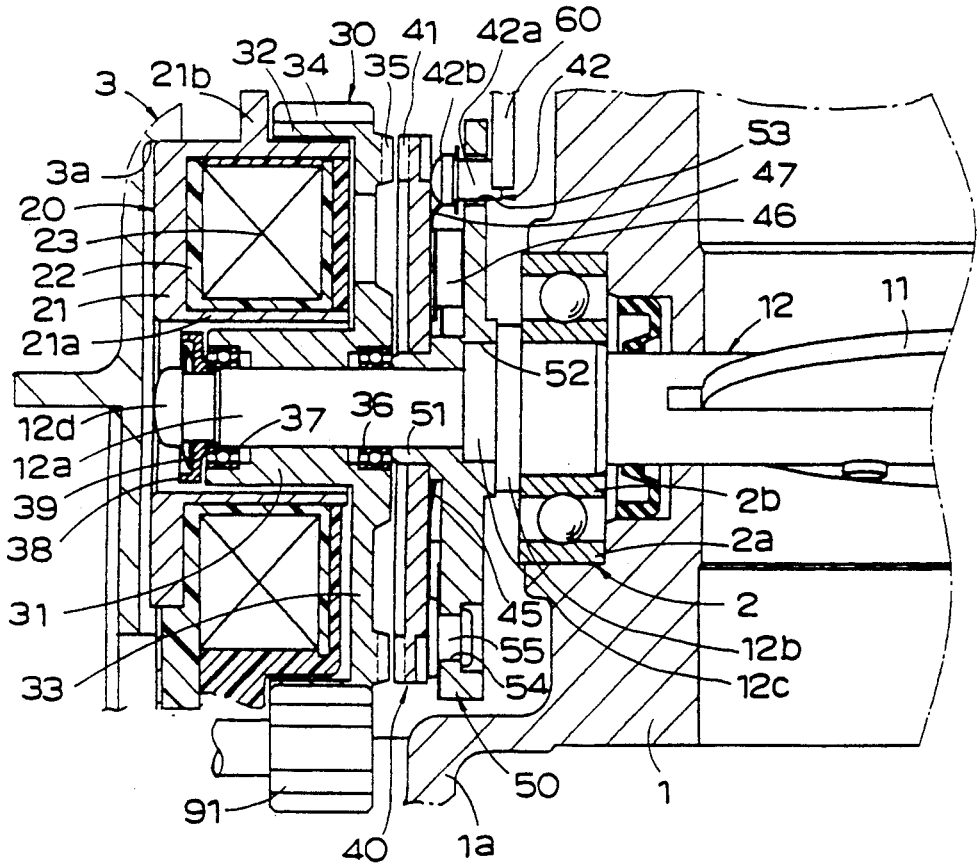
FIG. 4 is an enlarged sectional view of a throttle shaft section according to an embodiment of the present invention.

Referring to FIGS. 1 to 5, there is illustrated a throttle control apparatus according to an embodiment of the present invention, wherein a throttle valve 11 is disposed in an intake duct of a housing 1 of an internal combustion engine (not shown). The throttle valve 11 is fixed to a throttle shaft 12 which is rotatably mounted on the housing 1 through a bearing 2 whose outer ring 2*a* is fitted into the housing 1. The throttle shaft 12 has an end portion extending from the housing 1. A case 1*a* is integrally formed with a side wall of the housing 1 which supports an extending portion 12*a* of the throttle shaft 12, and a lid 3 is fixed to the case 1*a* so as to define a chamber which receives main components constituting the throttle control apparatus according to the present embodiment. At a base end of the extending portion 12*a* of the throttle shaft 12, formed are a flange portion 12*b* and a stepped portion 12*c* having a cross-section of a circle with parallel cutouts, as shown in FIG. 4. The flange portion 12*b* contacts an inner ring 2*b* of the bearing 2 so as to place the same at a certain position.

At a side wall of the housing 1, which is opposite to the case 1*a* and which supports the other end of the throttle shaft 12, a cylindrical support 4 is formed integrally with the housing 1, as shown in FIG. 2. Connected to the support 4 is a return spring (not shown) which biases the throttle shaft 12 to close the throttle valve 11. Linked to a tip portion of the other end of the throttle shaft 12 is a throttle sensor 13 which detects an opening angle of the throttle valve 11 or a rotational angle of the throttle shaft 12. The throttle sensor 13 is arranged to convert the rotational angle of the throttle shaft 12 into an electric signal, and its structure is already known, so that the explanation thereof will be omitted. From the throttle sensor 13, a throttle idle switch signal indicative of the fully closed position of the throttle valve 11 is fed to a controller 100, and also a throttle position signal corresponding to the opening angle of the throttle valve 11 is fed to the controller 100.

In FIG. 4, a clutch holder 50, which constitutes a supporting member according to the present invention, is disposed so as to contact the flange portion 12*b* of the throttle shaft 12. The clutch holder 50 is formed of a circular disc, in the center of which a hollow shaft portion 51 is provided, and a hole 52 having a cross-section of a circle with parallel cutouts and communicating with the hollow shaft portion of the shaft 51 is defined. Therefore, when the shaft 51 of the clutch holder 50 is inserted into the extending portion 12*a* of the throttle shaft 12, and the stepped portion 12*c* is fitted into the hole 52 having the same cross-section as that of the former, then the clutch holder 50 will rotate integrally with the throttle shaft 12, without rotating about the throttle shaft 12. At an outer peripheral portion of the clutch holder 50, defined are a hole 53 through which a pin 42 described later will be disposed, and holes 54 to which a leaf spring 45 described later will be caulked. A clutch plate 40 corresponding to a movable member of the present invention is mounted on the shaft portion 51 of the clutch holder 50 movably in the axial direction thereof. The clutch plate 40 is a circular magnetic plate which is provided with teeth 41 formed radially and each having a triangular cross-section. The teeth 41 can be formed by cutting or electric discharge machining on a surface of the clutch plate 40, and also can be formed by press working.

Figure 6:
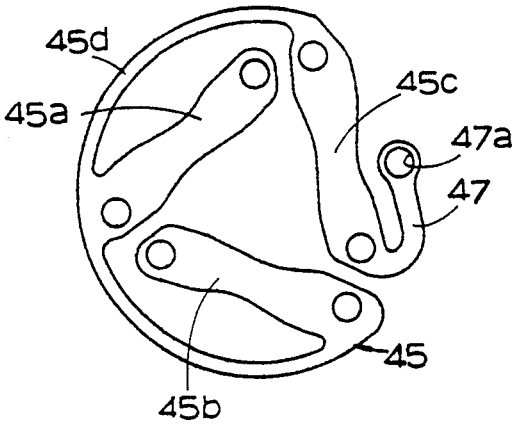
FIG. 6 is a plan view of a leaf spring according to an embodiment of the present invention.

The clutch plate 40 and the clutch holder 50 are connected by a leaf spring 45. One end portion of the leaf spring 45 is fixed to the clutch plate 40 by a pin 46, the other end portion of the spring 45 is fixed to the clutch holder 50 by a pin 55. The leaf spring 45 is produced by press working from a sheet of plate made of spring material. As shown in FIG. 6, the leaf spring 45 has three connecting portions 45*a*, 45*b*, 45*c* for connecting the clutch plate 40 with the clutch holder 50, which form an approximately triangular configuration, and whose end portions are integrally connected with each other by an arc frame 45*d*. The connecting portion 45*c* has an auxiliary leaf 47 extending from its free end. A hole 47*a* is defined in a free end portion of the auxiliary leaf 47. Each of the connecting portions 45*a*–45*c* has holes defined at the opposite ends respectively, and narrow width in the middle portion so as to provide a certain spring property.

Figure 7:
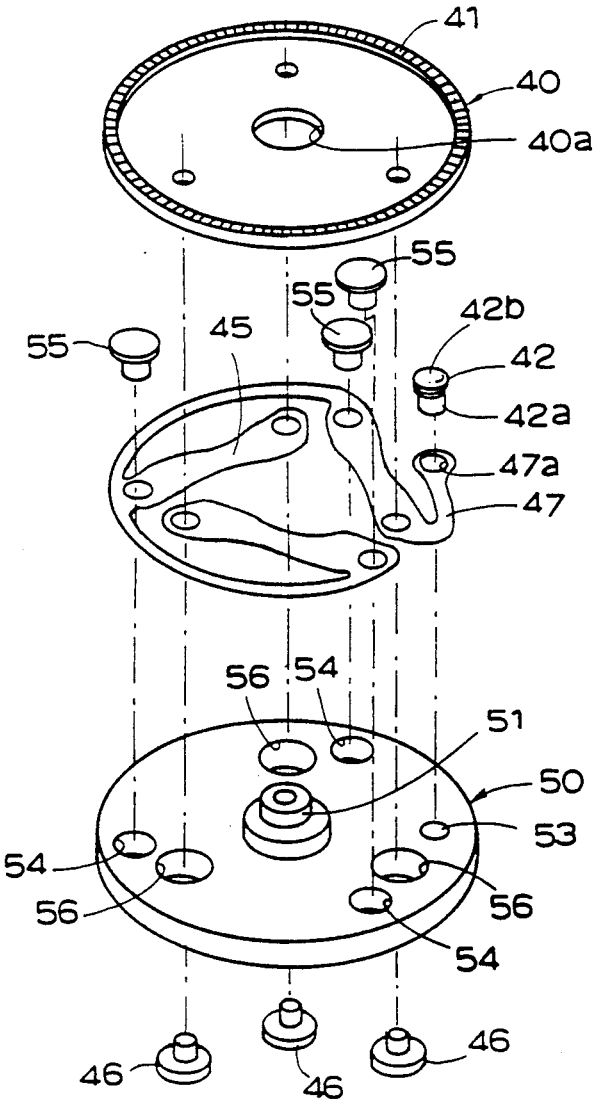
FIG. 7 is a perspective view of a clutch plate, a leaf spring and a clutch holder illustrating a state for assembling them according to an embodiment of the present invention.

As shown in FIG. 7, the leaf spring 45 is fixed to the clutch plate 40 by pins 46 which are inserted through the holes defined at one side of the connecting portions 45*a*–45*c*, and fixed to the clutch holder 50 by pins 55 inserted through the holes defined at the other side of the connecting portions 45*a*–45*c*. Thus, both the connecting portion 45*c* of the leaf spring 45 and the auxiliary leaf 47 are supported on the clutch plate 40 by the pin 46. For assembling these parts, at the outset, the leaf spring 45 is fixed to the clutch holder 50 with the pins 55 caulked into the holes 54, and the pin 42 is inserted into a hole 53 of the clutch holder 50 through the hole 47*a* of the auxiliary leaf 47. Then, the clutch plate 40 is mounted on the shaft portion 51 of the clutch holder 50 which is inserted into a hole 40*a* defined in the center of the clutch plate 40. The leaf spring 45 is fixed to the clutch plate 40 by the pins 46 which are inserted through the holes 56 and caulked to the clutch plate 40. Consequently, the clutch plate 40 and the clutch holder 50 are connected with each other, and the pin 42 is held to be upright with a head portion 42*b* of the pin 42 pressed onto the clutch plate 40 by the biasing force of the auxiliary leaf 47. As for the clutch holder 50 connected with the clutch plate 40 as described above, its shaft portion 51 is mounted on the extending portion 12*a* of the throttle shaft 12 as shown in FIG. 4, and a bearing 36 is press-fitted onto the extending portion 12*a* such that an inner ring of the bearing 36 contacts the tip end of the shaft portion 51. Consequently, the clutch holder 50 is positioned at a predetermined position on the extending portion 12*a* of the throttle shaft 12.

A rotor 30 made of magnetic material is rotatably mounted on the extending portion 12*a* of the throttle shaft 12. The rotor 30 is made of sintered ferrous metal to form a shaft portion 31 as shown in FIG. 4, which is mounted on the extending portion 12*a* of the throttle shaft 12, a cylindrical portion 32 and arm portions 33 connecting therebetween. The rotor 30 is provided at an outer peripheral side of the cylindrical portion 32 with an external gear 34 integrally, and provided, in the vicinity of the external gear 34 on a planar portion perpendicular to its axis facing the teeth 41 of the clutch plate 40, with teeth 35 having a triangular cross-section and formed radially along the whole periphery of the rotor 30.

The shaft portion 31 of the rotor 30 is provided at one side thereof with a recess, into which an outer ring of the bearing 36 is fitted, and provided at the other side of the shaft portion 31 with another recess, into which an outer ring of the bearing 37 is fitted. Thus, the rotor 30 is mounted on the extending portion 12a through the bearings 36, 37. The inner ring of the bearing 37 is fitted onto the extending portion 12a of the throttle shaft 12, and a holder 38 is mounted thereon so as to contact a side of the inner which is screwed into the tip end of the extending portion 12a through a wave washer 39, so that the holder 38 is pressed axially toward the rotor 30 so as to avoid an axial backlash thereof. Thus, the rotor 30 is positioned exactly at a predetermined position on the extending portion 12a of the throttle shaft 12, and mounted thereon so as to be rotatable smoothly around the extending portion 12a.

Figure 5:
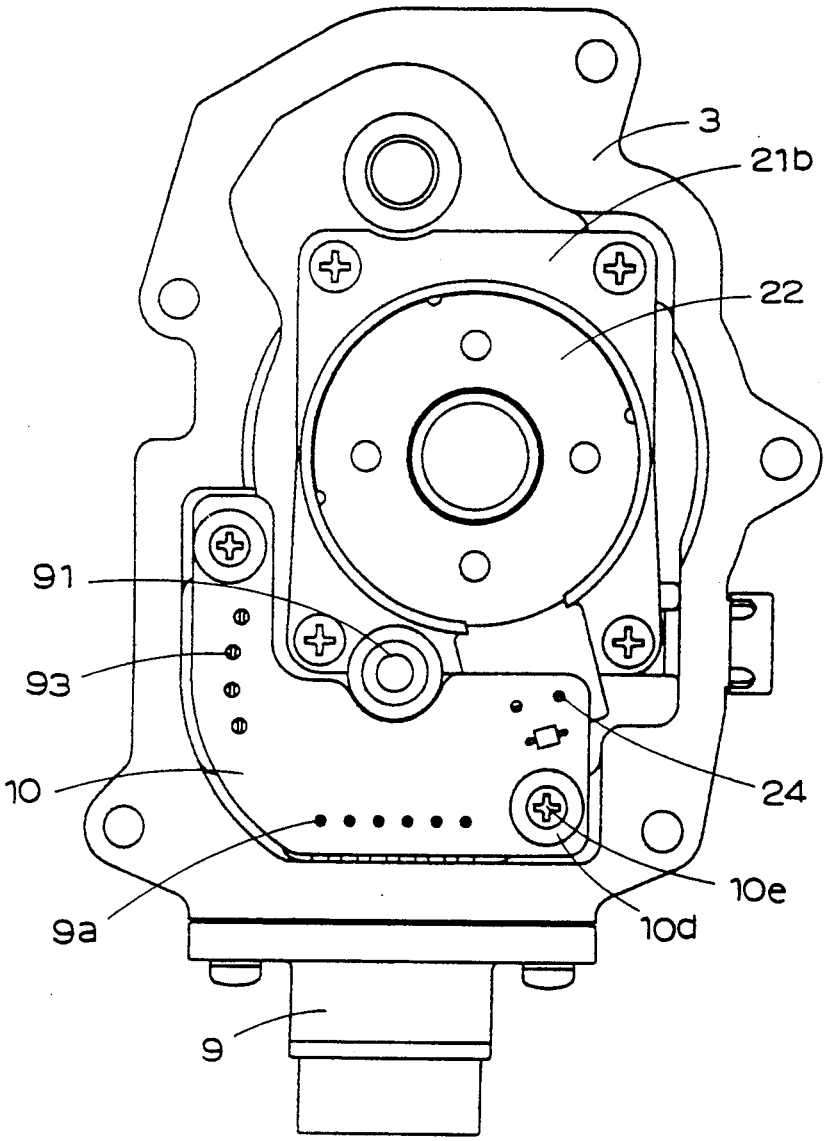
FIG. 5 is a front view illustrating an inside at a lid's side according to an embodiment of the present invention.

As for the lid 3, formed in approximately center thereof is a recess 3a, into which the electromagnetic coil 20 is fitted by spigot such that its central axis is on the central axis of the throttle shaft 12. As shown in FIGS. 4 and 5, the electromagnetic coil 20 is provided with a yoke 21 made of magnetic material, and a coil 23 wound around a bobbin 22 made of resin. The yoke 21 has at the center thereof a cylindrical portion 21a, around which is defined an annular hollow portion with bottom in which the bobbin 22 and the coil 23 are received. Around the outer periphery of the yoke 21, there is formed a flange portion 21b, which is fixed to the lid 3 by screws as shown in FIG. 5. When the lid 3 is connected to the case 1a, the outer peripheral side of the yoke 21 will be surrounded by the cylindrical portion 32 of the rotor 30, and the rotor 30 will be held such that the shaft portion 31 will be overlapped by the cylindrical portion 21a of the yoke 21 along its axis with a predetermined clearance therebetween. Consequently, a magnetic loss caused at a gap between the yoke 21 and the rotor 30 will be minimized to ensure a predetermined magnetic permeance.

As shown in FIG. 4, the pin 42, which is supported on the clutch plate 40 and which constitutes an engaging member according to the present invention, has a columnar main body 42a and a head portion 42b whose axial ends are spherical. That is, the bottom and shoulder of the head portion 42b are formed to have spherical surface. The hole 47a (in FIG. 6) of the auxiliary leaf 47 is set to have a diameter which enables only the main body 42a of the pin 42 to pass through the hole 47a, and the tip end of the head portion 42b is pressed onto the clutch plate 40, so that the pin 42 will be held approximately perpendicular to the planar surface of the clutch plate 40. The main body 42a of the pin 42 is inserted into the hole 53 to be movable therein, and the tip end of the main body 42a is normally extending out of the hole 53 of the clutch holder 50 as shown in FIG. 4.

In the vicinity of the pin 42 supported to be pressed onto the clutch plate 40, a driving plate 60 corresponding to a driving member of the present invention is disposed, so as to face the clutch holder 50 at each outer peripheral portion. The driving plate 60 is a plate forming a cam as shown in FIG. 2, and secured at its one end portion to an accelerator shaft 62, which is mounted on the housing 1 in approximately parallel spaced relationship with the throttle shaft 12. That is, an outer ring 65a of a bearing 65 is fitted into a bearing portion 1b formed in the housing 1, and an outer ring 66a of a bearing 66 is fitted into a bearing portion 3b formed in the lid 3. Then, an accelerator shaft 62 is mounted to be smoothly rotatable in the bearings 65, 66.

Figure 8:
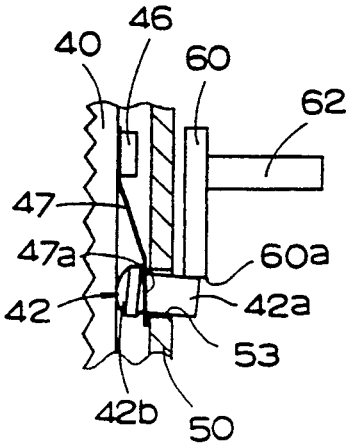
FIG. 8 is a plan view showing a relationship between a driving plate and a pin according to an embodiment of the present invention.

The driving plate 60 is disposed such that when the electromagnetic coil 20 is de-energized, an end face 60a of the driving plate 60 will contact and engage with the side surface of the main body 42a of the pin 42 in response to rotation of the driving plate 60 around the accelerator shaft 62, i.e., in response to depression of the accelerator pedal 7. And, it is so arranged that when the end face 60a of the driving plate 60 contacts the main body 42a of the pin 42 to apply a driving force against the pin 42, the pin 42 can be rotated about the head portion 42b within a predetermined angle range. That is, the pin 42 is inclined against the clutch plate 40 in the hole 47a of the auxiliary leaf 47 by the driving force of the driving plate 60, and held to be in the inclined state at a predetermined angle with the pin 42 contacting the hole 53 of the clutch holder 50, as shown in FIG. 8, so that the clutch plate 40 and the clutch holder 50 can be rotated in response to rotation of the driving plate 60. Thus, the clutch plate 40 is held without inclining to its rotational axis, and maintains approximately even clearance along the whole periphery of the rotor 30. The inclined angle of the pin 42 may be set within a predetermined angle range by recourse to only the relationship between the auxiliary leaf 47 and the main body 42a, without causing the pin 42 to contact the hole 53 of the clutch holder 50. In lieu of the hole 47a of the auxiliary leaf 47, a U-shaped portion may be formed on the tip end portion of the auxiliary leaf 47. In this case, however, the pin 42 must be engaged with the hole 53 of the clutch holder 50.

Figure 10:
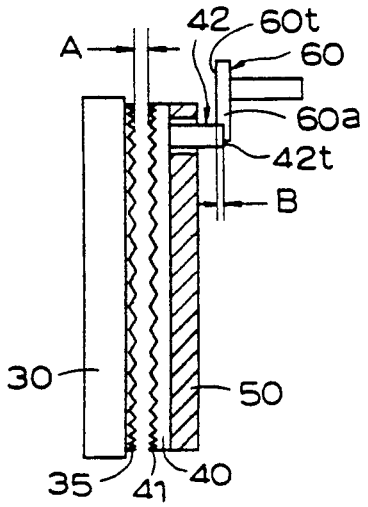
FIG. 10 is a side view of a pin, a driving plate, a clutch holder, a clutch plate and a rotor illustrating their relationship when an electromagnetic coil is de-energized according to another embodiment of the present invention.
Figure 11:
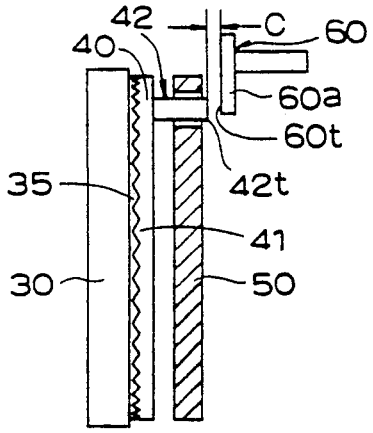
FIG. 11 is a side view of the pin, driving plate, clutch holder, clutch plate and rotor illustrating their relationship when the electromagnetic coil is energized according to another embodiment of the present invention.
Figure 12:
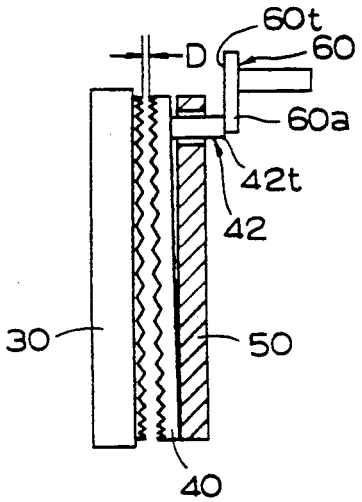
FIG. 12 is a side view of the pin, driving plate, clutch holder, clutch plate and rotor illustrating a state where the pin contacts the driving plate when the electromagnetic coil is de-energized, according to another embodiment of the present invention.

As another embodiment, the axial length of the pin 42 may be determined as follows. FIGS. 10 to 12 schematically illustrate the relationship between the pin 42 and the driving plate 60, omitting the above-described structure for supporting the pin 42 on the clutch plate 40. As shown in FIG. 10 which illustrates the state wherein the electromagnetic coil 20 is de energized, the axial length of the pin 42 is long enough to contact the end face 60a of the driving plate 60. The distance (B) between a free end 42t of the pin 42 and a side surface 60t of the driving plate 60 is set to be smaller than the distance (A) between the clutch plate 40 and the rotor 30, i.e., between the tip ends of their teeth. These plates are perpendicular to the axis of the throttle shaft 12. Then, as shown in FIG. 11, in such a state that the electromagnetic coil 20 is energized so that the clutch plate 40 is attracted by the rotor 30 to engage the teeth 35 with the teeth 41, it is so arranged that a certain clearance (C) is made between the free end 42t of the pin 42 and the side surface 60t of the driving plate 60.

Consequently, in the case where the clutch plate 40 is connected to the rotor 30 and the driving plate 60 is rotated, and then the electromagnetic coil 20 is de-energized when the side surface 60t is positioned on the axis of the pin 42, the free end 42t will contact the side surface 60t of the driving plate 60 as shown in FIG. 12. However, since there will be formed a clearance $D(=A-B)$ between the clutch plate 40 and the rotor 30, these will not interfere with each other.

As shown in FIG. 3 the accelerator shaft 62 has a main body 62a formed at one end portion thereof with a flange portion 62b having a larger diameter than that of the main body 62a, and a stepped portion 62c having a cross-section of a circle with parallel cutouts and having the same diameter as that of the main body 62*a*, and further formed with a support portion 62*d* having a smaller diameter than that of the main body 62*a*. It is so arranged that the inner ring 65*b* of the bearing 65 is fitted onto the support portion 62*d*, and that the side surface of the stepped portion 62*c* contacts only the inner ring 65*b* of the bearing 65. On the stepped portion 62*c* of the accelerator shaft 62, mounted is the driving plate 60 through a hole (not shown) defined therein and having the same cross section as that of the stepped portion 62*c*, then the driving plate 60 and the accelerator shaft 62 are welded together, so that the driving plate 60 rotates integrally with the accelerator shaft 62.

On the accelerator shaft 62, mounted are a spring holder 63, which has a cylindrical main body 63*a* and a flange portion 63*b* formed at an end thereof, and a coil spring 64, which is mounted on the main body 63*a*, between the bearings 65 and 66. That is, the coil spring 64 is disposed between the flange portion 62*b* and the flange portion 63*b* to expand therebetween by its biasing force. It is so arranged that the flange portion 63*b* of the spring holder 63 contacts only the inner ring 66*b* of the bearing 66. Therefore, the accelerator shaft 62 is restricted to move in the axial direction between the bearing portion 1*b* of the housing 1 and the bearing portion 3*b* of the lid 3 to be positioned at a predetermined position. Thus, the driving plate 60 which is fixed to the accelerator shaft 62 will be held at the predetermined position, and any dislocation due to vibration or the like will not be caused.

An accelerator link 5 is connected to the tip end of the other end portion of the accelerator shaft 62, and fixed thereto by a nut (or bolt) 62*f* through a washer 62*e*. The accelerator link 5 is provided integrally with a lever 5*a* for holding an end of an accelerator cable 6 and a lever 8*a* for actuating an accelerator sensor 8. The other end of the accelerator cable 6 is connected to the accelerator pedal 7 as shown in FIG. 2 to constitute an accelerator operating mechanism, whereby the driving plate 60 fixed to the accelerator shaft 62 rotates about the axis of the accelerator shaft 62 in response to depression of the accelerator pedal 7.

A pair of return springs 5*b*, 5*c* are mounted on the accelerator shaft 62 outside of the lid 3, and covered by a holder 5*d*. One end of each of the return springs 5*b*, 5*c* is secured to the accelerator link 5 and the other end is secured to an upright wall portion 3*c* of the lid 3, so that the accelerator shaft 62 is biased toward a predetermined initial position. That is, the accelerator shaft 62 is biased such that the accelerator pedal 7, which is connected to the accelerator shaft 62 through the accelerator cable 6, returns to its fully closed position. For covering these return springs 5*b*, 5*c*, fixed to the lid 3 is a bracket 80, on which the accelerator sensor 8 is mounted. In response to rotation of the accelerator link 5, therefore, the accelerator sensor 8 is actuated by a lever 8*a* which is integrally formed with the accelerator link 5, so that a rotational angle of the accelerator shaft 62, i.e., a depressed amount of the accelerator pedal 7 is detected to output a signal corresponding to the depressed amount to the controller 100.

Figure 1:
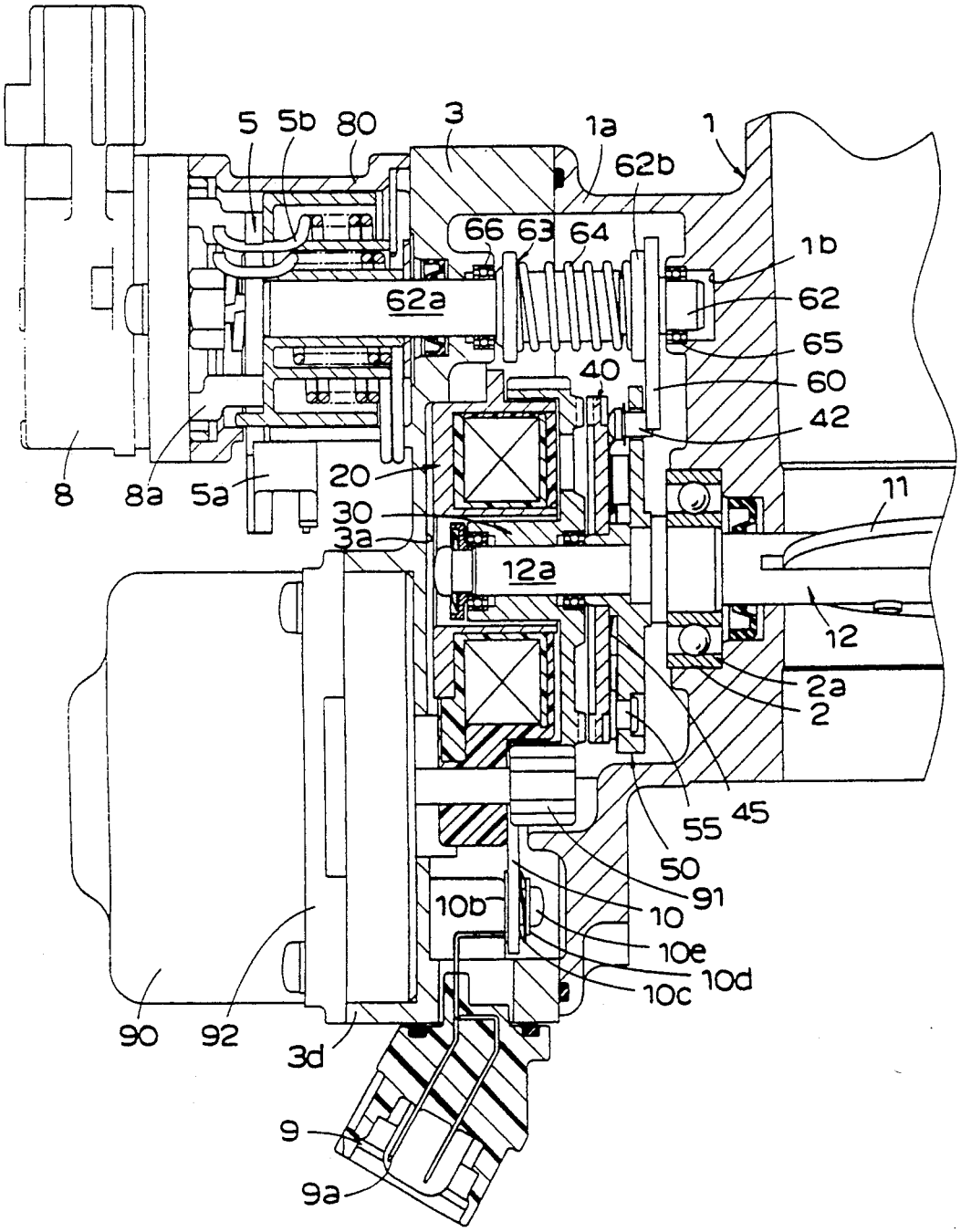
FIG. 1 is a sectional view of a throttle control apparatus according to an embodiment of the present invention.

As shown in FIGS. 1 and 2, secured to the lid 3 is a motor 90 which constitutes a driving source according to the present invention, and whose rotational shaft is supported rotatably in parallel with the throttle shaft 12. At the tip end of the rotational shaft of the motor 90, fixed is a pinion gear 91 which is positioned so as to mesh with the external gear 34 formed around the periphery of the rotor 30. The motor 90 has a flange portion 92 which is fixed by screws to a cylindrical supporting portion 3*d* formed on the lid 3. In the present embodiment, employed as the motor 90 is a step motor which is controlled by the controller 100, while other motors such as a DC motor may be employed.

As shown in FIG. 5, a terminal 93 of the motor 90, a terminal 24 of the electromagnetic coil 20 and a terminal 9*a* of a connector 9 extend in the same direction (rightward in FIG. 1) to be electrically connected with a circuit (not shown) printed on a printed wiring board 10. In the printed wiring board 10, defined is a hole (not shown) in which a collar (not shown) having a cylindrical portion of a small outer diameter and a flange portion of a large outer diameter is disposed to provide a certain clearance between the cylindrical portion and the hole. And, a wave washer (not shown) is disposed around the collar and a screw 10*e* is fixed to the lid 3 through a washer 10*d* and the cylindrical portion of the collar. Consequently, a thermal stress caused on a portion connecting the printed wiring board 10 with the lid 3 is absorbed, so that the printed wiring board 10 is supported stably on the lid 3. Since the motor 90, electromagnetic coil 20 and connector 9 are disposed on the lid 3 as described above, and the motor 90 and electromagnetic coil 20 are electrically connected to the connector 9 through the printed wiring circuit 10, these are easily assembled and easily wired. The connector 9 is connected to the controller 100 as shown in FIG. 2.

The controller 100 is provided with a control circuit having a microcomputer and mounted on a vehicle to receive output signals from various sensors so as to perform various controls including the control of the electromagnetic coil 20 and that of the motor 90. According to the present embodiment, the controller 100 is arranged to control various systems such as an acceleration slip control system and an automatic speed control system for controlling a vehicle to run at a constant speed, in addition to a conventional control system performed in accordance with the operation of the accelerator pedal 7, which are described in the Japanese Patent Laid-open publication 3-939 so that the explanation of each system will be omitted herein.

Next will be explained the operation of the throttle control apparatus according to the present embodiment. When the motor 90 is driven to rotate the pinion gear 91, the rotor 30 having the external gear 34 meshed with the pinion gear 91 will rotate about the throttle shaft 12. In this case, when the electromagnetic coil 20 is in the de-energized state, the clutch plate 40 is positioned away from the rotor 30 and close to the clutch holder 50, by a biasing force of the leaf spring 45. That is, the clutch plate 40, clutch holder 50 and throttle valve 11 are in such a state as to be freely rotatable about the throttle shaft 12 irrespective of the rotor 30. The pin 42, which is biased to be pressed onto the clutch plate 40 by the auxiliary leaf 47, is in such a state that the end face 60*a* can contact the pin 42 in response to rotation of the driving plate 60.

When an electric current is fed to the coil 23 of the electromagnetic coil 20 to energize the yoke 21 and rotor 30, the clutch plate 40 will be forced to move toward the rotor 30 by the electromagnetic force against the biasing force of the leaf spring 45, so that the teeth 35, 41 will be meshed theretogether. That is, the clutch plate 40 and the rotor 30 will be connected to each other, so that both will be rotatable together. Whereby, the driving force by the motor 90 is transmitted to the rotor 30 through the pinion gear 91 and the external gear 34 of the rotor 30, then transmitted to the clutch plate 40 through the teeth 35 of the rotor 30 and the teeth 41 of the clutch plate 40, and then transmitted to the clutch holder 50 through the leaf spring 45, and further transmitted to the throttle shaft 12 integrally rotated with the clutch holder 50, so that the opening angle of the throttle valve 11 will be controlled in accordance with the amount driven by the motor 90. In this case, the pin 42 moves toward the rotor 30 together with the clutch plate 40, irrespective of rotation of the driving plate 60, so that the end face 60*a* will not be engaged with the pin 42.

In the case where the throttle valve 11 is opened, when the supply of the electric current to the coil 23 is terminated, the relationship between the teeth 41 of the clutch plate 40 and the teeth 35 of the rotor 30 meshed with each other will be terminated, so that the throttle valve 11 will be fully closed by the biasing force of the return spring (not shown) in the support 4. Consequently, the end face 60*a* of the driving plate 60 will be positioned to be engageable with the main body 42*a* of the pin 42. In this state, when the driving plate 60 is rotated, the end face 60*a* will contact the main body 42*a* of the pin 42, and the clutch plate 40 and the clutch holder 50 will be rotated to open the throttle valve 11.

Figure 9:
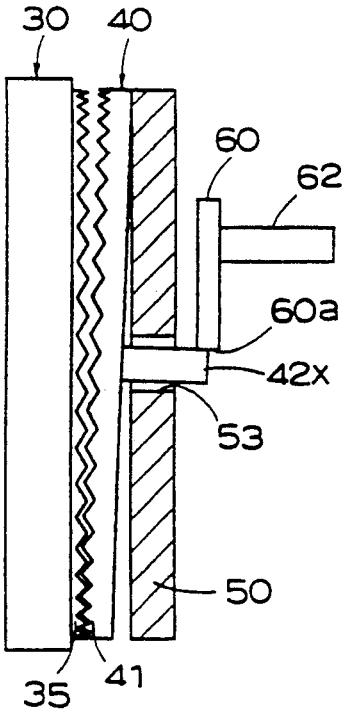
FIG. 9 is a plan view of a driving plate, a pin, a clutch plate and a rotor in a comparing example to be compared with those according to an embodiment of the present invention.

In this respect, the spherical head portion 42*b* of the pin 42 is pressed onto the clutch plate 40 by the auxiliary leaf 47, and supported so as to be rotatable within the predetermined angle range, so that even if the driving plate 60 is engaged with the pin 42 and the driving force is applied thereto, the clutch plate 40 will not be inclined against the rotating axis, and the clutch plate 40 will not be engaged with the rotor 30 erroneously. In contrast to the present embodiment, FIG. 9 illustrates a comparing example wherein a pin 42*x* is fixed to a position remote from the axial center of the clutch plate 40, and wherein the clutch plate 40 and the rotor 30 are engageable with each other through the teeth 41, 35 formed on their outer peripheral portions respectively. In this example, when the driving force of the driving plate 60 is applied to the tip end of the pin 42*x*, the clutch plate 40 will be inclined as shown in FIG. 9, so that a portion of the clutch plate 40 will be engaged with the rotor 30.

Figure 13:
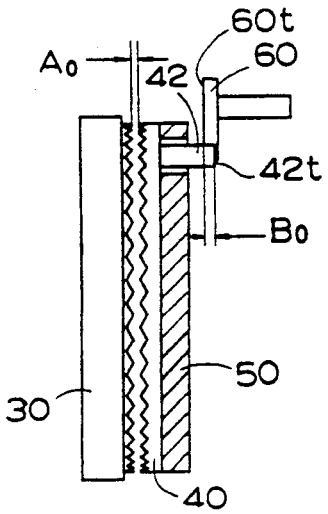
FIG. 13 is a side view of a pin, a driving plate, a clutch holder, a clutch plate and a rotor in a comparing example to be compared with those of the embodiment of the present invention, illustrating their relationship when an electromagnetic coil is de-energized.
Figure 14:
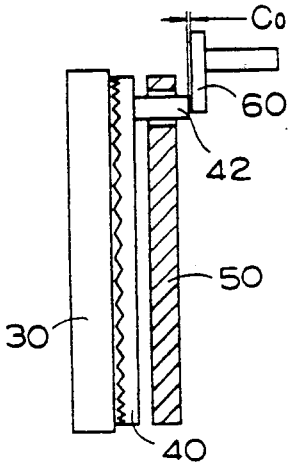
FIG. 14 is a side view of the pin, driving plate, clutch holder, clutch plate and rotor in the comparing example, illustrating their relationship when the electromagnetic coil is energized.
Figure 15:
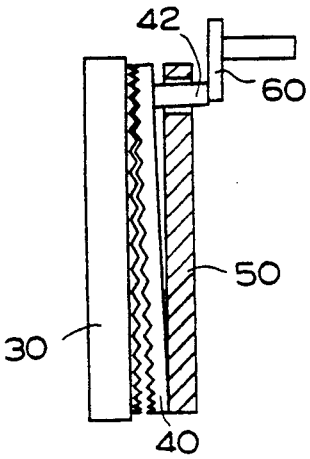
FIG. 15 is a side view of the pin, driving plate, clutch holder, clutch plate and rotor in the comparing example, illustrating a state where the pin contacts the driving plate when the electromagnetic coil is de-energized.

As for another embodiment, in the case where the clutch plate 40 is connected to the rotor 30 and the driving plate 60 is rotated, and then the electromagnetic coil 20 is de-energized when the side surface 60*t* is positioned on the axis of the pin 42, the free end 42*t* will contact the side surface 60*t* of the driving plate 60 as shown in FIG. 12, but the clutch plate 40 and the rotor 30 will not interfere with each other. FIGS. 13 to 15 relate to an example to be compared with the embodiment, wherein the axial length of the pin 42 is set such that the distance (Bo) between the free end 42*t* of the pin 42 and the side surface 60*t* of the driving plate 60 is longer than the distance (Ao) between the clutch plate 40 and the rotor 30, i.e., between the tip ends of their teeth, and that when the electromagnetic coil 20 is energized to connect the clutch plate 40 with the rotor 30, there is formed a predetermined clearance (Co) between the free end 42*t* and the side surface 60*t* with their teeth meshed with each other. In this example, however, the difference (Ao−Bo) between the distance (Ao) and (Bo) is of a negative value. Therefore, supposing that the clutch plate 40 is connected with the rotor 30, and that the driving plate 60 is rotated to position its side surface 60*t* on the axis of the pin 42, and the electromagnetic coil 20 is de-energized, the free end 42*t* of the pin 42 will contact the side surface 60*t* of the driving plate 60 to thereby prevent the clutch plate 40 from returning toward the clutch holder 50. Thus, the relationship between the clutch plate 40 and the rotor 30 meshed with each other will be maintained at a position near the pin 42 fixed to the clutch plate 40, so that the desired operation will not be performed.

As described above, when the electromagnetic coil 20 is energized in the embodiments, the driving plate 60 and the pin 42 will be disengaged certainly, and when the electromagnetic coil 20 is de-energized, they will be positioned to be engageable with each other, while the clutch plate 40 and the rotor 30 will be disengaged.

Hereinafter will be described the operation of the throttle control apparatus of the above-described embodiments in response to driving of an automobile equipped with the throttle control apparatus. In a normal accelerator control operation, when the accelerator pedal 7 is depressed, the output corresponding tot he depressed amount will be fed from the accelerator sensor 8 to the controller 100, in which a desired throttle opening angle is determined in accordance with the accelerator operating amount, i.e., the depressed amount of the accelerator pedal 7. When the throttle shaft 12 is rotated by the motor 90, the signal corresponding to the rotational angle of the throttle shaft 12 will be fed from the throttle sensor 13 to the controller 100, which will actuate the motor 90 so as to rotate the throttle valve 11 to be positioned at the desired throttle opening angle. Thus, the throttle opening angle is controlled in accordance with the depressed amount of the accelerator pedal 7, so that an engine power corresponding to the opening angle of the throttle valve 11 is obtained. As described above, without any mechanical connection between the accelerator pedal 7 and the throttle valve 1, it is possible to start and drive the automobile smoothly in response to depression of the accelerator pedal 7. When the accelerator pedal 7 is released, the throttle valve 11 is fully closed by the biasing force of the return spring (not shown) in the support 4 and the driving force of the motor 90.

Since the driving plate 60 and the pin 42 are not engaged with each other in the normal driving mode as described above, even if the accelerator pedal is depressed more than the predetermined amount, no mechanical interference will be caused against the throttle control by the motor 90. Therefore, in the case where an acceleration slip is caused when the automobile is running on a road of a low coefficient of friction to initiate an acceleration slip control mode for example, even if the driver depress the accelerator pedal 7 largely, and even if the electromagnetic coil 20 is de-energized by some reason during the transition period to the acceleration slip control mode, the throttle valve 11 will be fully closed to achieve the acceleration slip control and maintain a stable running.

In the case where an abnormality in the apparatus including an abnormal operation of the throttle valve 11 is detected, the electromagnetic coil 20 will not be energized, so that the rotor 30 and the clutch plate 40 will be positioned away from each other, and the throttle valve 11 will be returned to its initial position by the return spring in the support 4. Also, the operation of the rotor 30 driven by the motor 90 will be stopped. In this case, the clutch plate 40 will move toward the clutch holder 50, so that the pin 42 will be positioned to be engageable with the end face 60*a* of the driving plate 60. Therefore, if the accelerator pedal 7 is depressed more than the predetermined amount, the end face 60*a* of the driving plate 60 will contact the pin 42, and the throttle shaft 12 will be rotated with the clutch plate 40 and the clutch holder 50. Thereafter, the driving force of the accelerator pedal 7 by the driver can be directly transmitted to the throttle shaft 12.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A throttle control apparatus for an internal combustion engine, comprising:

an accelerator operating mechanism;

a driving source for producing a driving force in accordance with an amount of operation of said accelerator operating mechanism;

a throttle valve disposed in a housing mounted on said internal combustion engine;

a throttle shaft rotatably mounted on said housing for supporting said throttle valve, said throttle shaft having at least an end portion extending out of said housing;

a supporting member secured to said end portion of said throttle shaft;

a rotor rotatably mounted on said end portion of said throttle shaft and positioned at a certain position thereof to prevent an axial movement of said rotor on said throttle shaft, said rotor being connected with said driving source to be rotated by said driving force;

a movable member mounted on said throttle shaft between said rotor and said supporting member movably in the axial direction of said throttle shaft;

a connecting member for connecting said movable member with said support member, and biasing said movable member toward said supporting member;

an electromagnetic coil secured to said housing for facing said rotor, said electromagnetic coil attracting said movable member toward said rotor, and connecting said movable member and said rotor when said electromagnetic coil is energized;

an engaging member having a base end mounted on said movable member for supporting said engaging member rotatably within a predetermined angle range, and having a free end extending in parallel with the axis of said throttle shaft; and a driving member mounted rotatably about an axis parallel with the axis of said throttle shaft, and having an end face engageable with said engaging member perpendicularly to the axis of said throttle shaft, said driving member being connected with said accelerator operating mechanism to be rotatable in response to operation of said accelerator operating mechanism, and said engaging member having an axial length engageable with said end face of said driving member only when said movable member is positioned at the side of said supporting member.

2. An apparatus as set forth in claim 1, wherein said engaging member comprises a pin having a shaft portion and a head portion provided at an end thereof, and a spring member mounted on said movable member for pressing said head portion onto said movable member, and holding said shaft portion normally in parallel with the axis of said throttle shaft.

3. An apparatus as set forth in claim 2, wherein said connecting member comprises a leaf spring having at least a portion thereof fixed to said movable member, and at least another portion fixed to said supporting member.

4. An apparatus as set forth in claim 3, wherein said spring member comprises an auxiliary leaf extending from said leaf spring and having an end portion engaged with said head portion of said pin for pressing said head portion onto said movable member.

5. An apparatus as set forth in claim 4, wherein said leaf spring has a plurality of connecting portions connected with each other, and wherein one of said connecting portions extends to provide said auxiliary leaf.

6. An apparatus as set forth in claim 3, wherein said leaf spring includes three connecting portions to form an approximately triangular configuration, and wherein one end of each connecting portion is connected with a peripheral portion, and the other end of each connecting portion is free from said peripheral portion.

7. An apparatus as set forth in claim 6, wherein said one end of each connecting portion is fixed to said supporting member, and the other end of each connecting portion is fixed to said movable member.

8. An apparatus as set forth in claim 7, wherein said spring member comprises an auxiliary leaf extending from the free end of one of said three connecting portions, said auxiliary leaf having a hole defined in a free end portion thereof, and wherein said pin is held in said hole and said head portion of said pin is pressed by said auxiliary leaf onto said movable member.

9. An apparatus as set forth in claim 8, wherein said head portion of said pin has a spherical surface at an end thereof to be pressed onto said movable member.

10. An apparatus as set forth in claim 9, wherein said head portion of said pin has another spherical surface at a shoulder thereof opposite to the end of said head portion to be pressed by said auxiliary leaf.

11. An apparatus as set forth in claim 1, wherein said engaging member has an axial length to satisfy that when said electromagnetic coil is de-energized and said engaging member is engageable with said end face of said driving member, a distance in parallel with the axis of said throttle shaft between a free end of said engaging member and a side surface of said driving member facing said movable member is smaller than a distance in parallel with the axis of said throttle shaft between a side surface of said movable member and a side surface of said rotor facing each other, and that when said electromagnetic coil is energized, a certain clearance is made between the free end of said engaging member and the side surface of said driving member.

12. An apparatus as set forth in claim 11, wherein said engaging member comprises a pin having a columnar shaft portion and a head portion provided at an end thereof, and a spring member mounted on said movable member for pressing said head portion onto said movable member, and holding said shaft portion normally in parallel with the axis of said throttle shaft.

13. An apparatus as set forth in claim 12, wherein said connecting member comprises a leaf spring having at least a portion thereof fixed to said movable member, and at least another portion fixed to said supporting member, and wherein said spring member comprises an auxiliary leaf extending from said leaf spring and having an end portion engaged with said head portion of said pin for pressing said head portion onto said movable member.

14. A throttle control apparatus for an internal combustion engine, comprising:

an accelerator operating mechanism;

a driving source for producing a driving force in accordance with an amount of operation of said accelerator operating mechanism;

a throttle valve disposed in a housing mounted on said internal combustion engine;

a throttle shaft rotatably mounted on said housing for supporting said throttle valve, said throttle shaft having at least an end portion extending out of said housing;

a supporting plate secured to said end portion of said throttle shaft, said supporting plate having a hole defined in parallel with the axis of said throttle shaft;

a rotor rotatably mounted on said end portion of said throttle shaft and positioned at a certain position thereof to prevent an axial movement of said rotor on said throttle shaft, said rotor being connected with said driving source to be rotated by said driving force, and said rotor being provided on a side surface thereof with teeth radially formed along the periphery of said rotor;

a movable plate mounted on said throttle shaft between said rotor and said supporting plate movably in the axial direction of said throttle shaft, said movable plate being provided on a side surface thereof facing said side surface of said rotor with teeth radially formed along the periphery of said movable plate;

a leaf spring for connecting said movable plate with said supporting plate, and biasing said movable plate toward said supporting plate;

an electromagnetic coil secured to said housing for facing said rotor, said electromagnetic coil attracting said movable plate toward said rotor, and engaging said movable plate with said rotor through said teeth thereof meshed with each other when said electromagnetic coil is energized;

a pin disposed on a side surface of said movable plate facing said supporting plate, said pin having a shaft portion disposed in said hole of said supporting plate and a head portion formed at an end of said shaft portion;

an auxiliary leaf mounted on said movable plate for pressing said head portion of said pin onto said movable plate, said auxiliary leaf holding said shaft portion of said pin normally in parallel with the axis of said throttle shaft and supporting said shaft portion rotatably about said head portion within said hole of said supporting plate; and a driving plate disposed in parallel with said supporting plate and mounted rotatably about an axis parallel with the axis of said throttle shaft, and having an end face engageable with said shaft portion of said pin perpendicularly to the axis of said throttle shaft, said driving plate being connected with said accelerator operating mechanism to be rotatable in response to operation of said accelerator operating mechanism, and said pin having an axial length engageable with said end face of said driving plate only when said movable plate is positioned at the side of said supporting plate.

15. An apparatus as set forth in claim 14, wherein said leaf spring has a plurality of connecting portions connected with each other, and wherein one of said connecting portions extends to provide said auxiliary leaf.

16. An apparatus as set forth in claim 14, wherein said pin has an axial length to satisfy that when said electromagnetic coil is de-energized and said pin is engageable with said end face of said driving plate, a distance in parallel with the axis of said throttle shaft between a tip end of said pin and a side surface of said driving plate facing said movable plate is smaller than a distance in parallel with the axis of said throttle shaft between said teeth of said movable plate and said teeth of said rotor, and that when said electromagnetic coil is energized, a certain clearance is made between the tip end of said pin and the side surface of said driving plate.

* * * * *